US005617927A

United States Patent [19]

Maissa

[11] Patent Number: 5,617,927

[45] Date of Patent: Apr. 8, 1997

[54] SIDEWALL ROTARY CORING TOOL

[75] Inventor: Jacques Maissa, Houston, Tex.

[73] Assignee: Western Atlas International, Inc., Houston, Tex.

[21] Appl. No.: 543,514

[22] Filed: Oct. 16, 1995

Related U.S. Application Data

[63] Continuation of Ser. No. 341,331, Nov. 16, 1994, abandoned, which is a continuation of Ser. No. 219,002, Mar. 29, 1994, abandoned, which is a continuation of Ser. No. 969,766, Oct. 3, 1992, abandoned.

[51] Int. Cl.[6] ..... E21B 49/06

[52] U.S. Cl. ..... 175/78; 175/40; 175/99

[58] Field of Search ..... 175/40, 44, 58, 175/77, 78, 99; 166/100

[56] References Cited

U.S. PATENT DOCUMENTS

| | | | |
|---|---|---|---|
| 2,546,668 | 3/1951 | Kirby, II | 175/78 |
| 2,546,670 | 3/1951 | Kirby, II | 175/78 |
| 4,714,119 | 12/1987 | Herbert et al. | 175/78 X |

FOREIGN PATENT DOCUMENTS

| | | | |
|---|---|---|---|
| 1265306 | 10/1986 | U.S.S.R. | 175/78 |

*Primary Examiner*—David J. Bagnell

*Attorney, Agent, or Firm*—Darryl M. Springs

[57] ABSTRACT

A sidewall coring tool for wireline use in an earth bore hole is provided which includes an elongated tool body adapted for suspension within the bore hole by the wireline cable at a selected depth, low speed high torque rotary coring bit apparatus mounted within the elongated tool body and cooperating therewith for advancing and retracting a rotary coring bit transversely therefrom for drilling and recovering a large core sample from the sidewall of the bore hole, and decentralizing arm apparatus mounted in the tool body on the side opposite the side of the body from which the rotary coring bit is advanced, the decentralizing arm apparatus spaced above and below the location of the rotary coring apparatus for deploying decentralizing arms from the tool body into contact with the bore hole walls and forcing the side of the tool body from which the rotary coring bit will be advanced into contact with the bore hole wall and for maintaining the tool body in rigid contact during the coring operation. In addition, the sidewall rotary coring tool further includes an electrical control circuit disposed on the earth's surface for permitting control of preselected functions of the rotary coring apparatus, and monitoring apparatus and circuitry disposed in the tool body and cooperating with the rotary coring bit apparatus for permitting continuous surface visual indication of the travel of the coring bit with respect to the tool body during the coring operation.

6 Claims, 10 Drawing Sheets

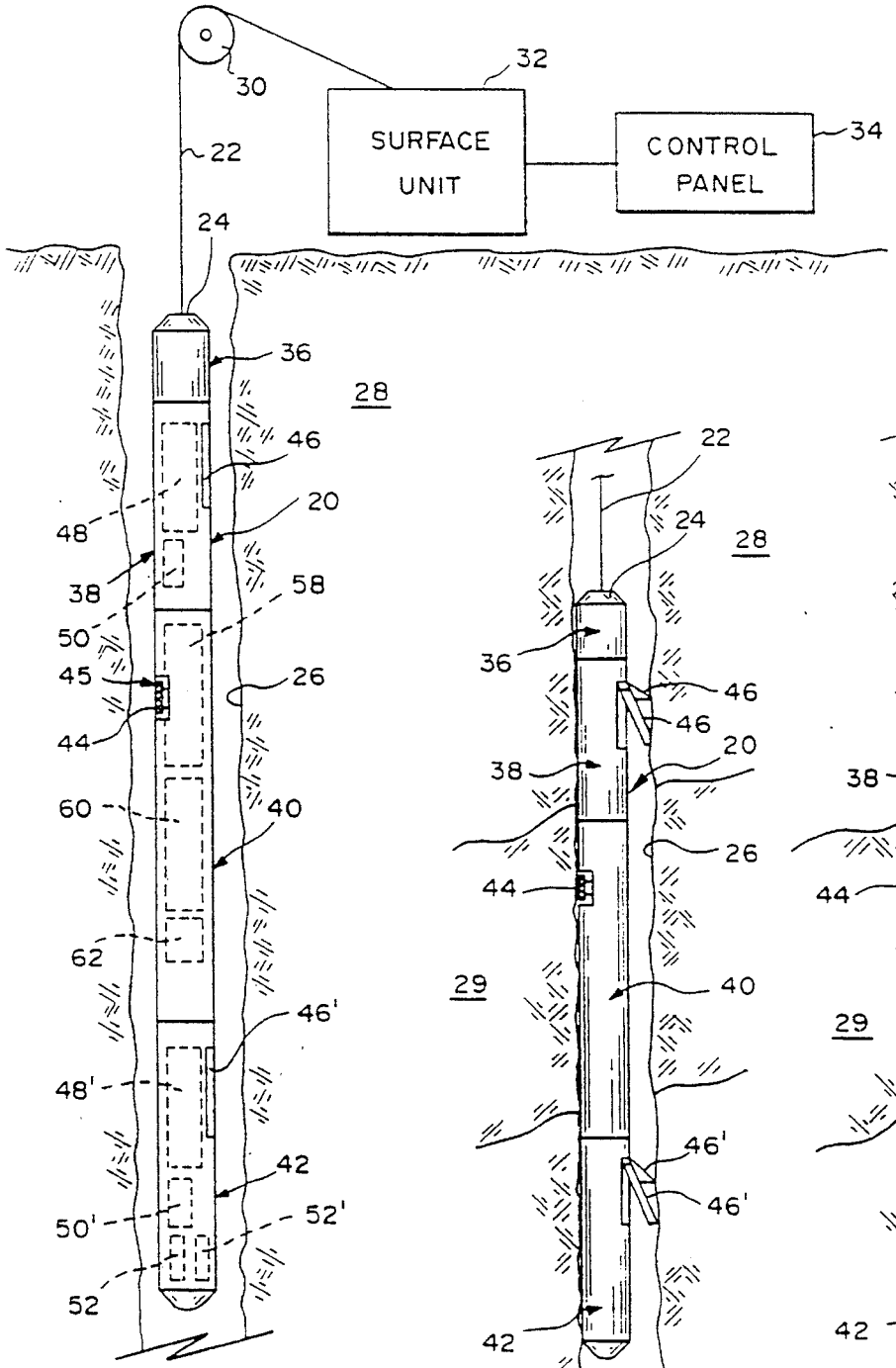
FIG. 1
FIG. 2a
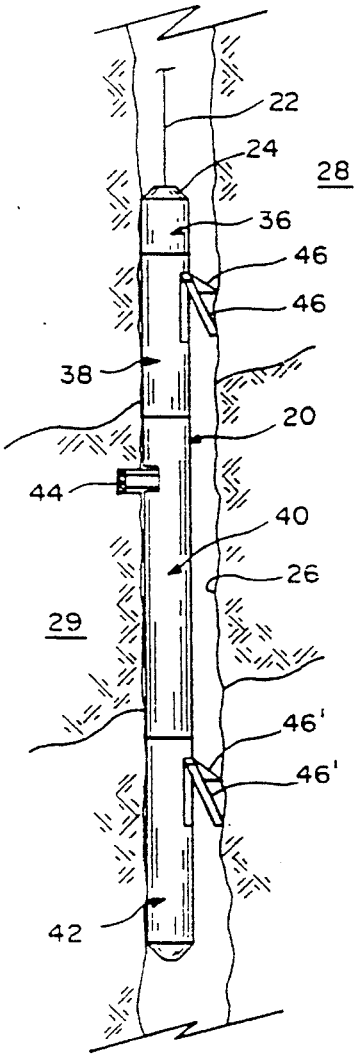
FIG. 2b

SIDEWALL ROTARY CORING TOOL

This is a continuation of application Ser. No. 08/341,331 filed on Nov. 16, 1994 (now abandoned) which is a continuation of application Ser. No. 08/219,002 filed Mar. 29, 1994 (now abandoned), which is a continuation of application Ser. No. 07/969,766 filed on Oct. 30, 1992, now abandoned.

BACKGROUND OF THE INVENTION

1. Field of the Invention

This invention relates to wireline apparatus for sidewall coring in oil and gas bore holes. More particularly, this invention relates to sidewall rotary coring apparatus for obtaining large sidewall cores in bore holes.

2. Discussion of Related Art

It is common geophysical practice to collect cores from oil and gas bore holes at known depths for analyzing the core materials in order to determine various characteristics of the subterranean earth formation. In oil and gas well bore holes, it is conventional to be able to obtain sidewall cores that are usually a maximum of 1.6 inches in length and 0.9 inches in diameter. The cores are recovered and analyzed at the surface to determine the physical properties of the formation adjacent to the bore hole.

The current sidewall coring tools are complex and do not allow the coring of large sidewall cores, cores larger than the 1.6 in.×0.9 in size mentioned above. The current tools use small high speed motors to drive the rotary coring apparatus which is not suitable in coring very hard rock formations, and have a tendency to become stuck in the formation. Most rotary sidewall coring tools have the drive motor axially aligned with the coring bit and tube which substantially limits the size of the motor and the length of the core that is obtainable in small diameter bore holes of 6 to 8 inches in diameter. Most coring tools do not have a reliable decentralizing arm system that is capable of exerting sufficient locking forces between the wall of the bore hole and the tool surface that will hold the tool in place during the coring operation, especially when the tool is coring in hard rock formations.

Accordingly, the present invention overcomes the deficiencies of the prior art by providing apparatus for rigidly anchoring the coring tool in place and an improved rotary coring apparatus for permitting the coring of large sidewall cores.

SUMMARY OF THE INVENTION

In accordance with one primary principle of the present invention, a sidewall coring tool for wireline use in an earth bore hole is provided which includes an elongated tool body adapted for suspension within the bore hole by the wireline cable at a selected depth, low speed high torque rotary coring bit apparatus mounted within the elongated tool body and cooperating therewith for advancing and retracting a rotary coring bit transversely therefrom for drilling and recovering a large core sample from the sidewall of the bore hole, decentralizing arm apparatus mounted in the tool body on the side opposite the side of the body from which the rotary coring bit is advanced, the decentralizing arm apparatus spaced above and below the location of the rotary coring apparatus for deploying decentralizing arms from the tool body into contact with the bore hole walls and forcing the side of the tool body from which the rotary coring bit will be advanced into contact with the bore hole wall and for maintaining the tool body in rigid contact during the coring operation. In addition, the sidewall rotary coring tool further includes an electrical control circuit disposed on the earth's surface for permitting control of preselected functions of the rotary coring apparatus, and monitoring apparatus and circuitry disposed in the tool body and cooperating with the rotary coring bit apparatus for permitting continuous surface visual indication of the travel of the coring bit with respect to the tool body during the coring operation.

In accordance with another principle of the present invention, the rotary coring apparatus has the capability of variable loading of the coring bit which is adjustable from the surface.

In accordance with another principle of the present invention, the rotary coring apparatus hydraulic circuit automatically permits the loading of the coring bit to be removed if the bit rotation torque is about to cause binding of the coring bit.

In accordance with another principle of the present invention, fluid flow is directed to the coring bit at all times during the coring operation to flush drill cuttings and debris and lessen the chances of the coring bit sticking or binding in the formation.

BRIEF DESCRIPTION OF THE DRAWINGS

In order that the manner in which the above-recited advantages and features of the invention are attained can be understood in detail, a more particular description of the invention can be had by reference to specific embodiments thereof which are illustrated in the accompanying drawings, which drawings form a part of this specification.

In the drawings:

FIG. 1 is a schematic view showing the lowering of the sidewall coring tool according to this invention into a bore hole.

FIG. 2A is a schematic view showing the sidewall coring tool according to this invention positioned in a bore hole with the decentralizing locking arm pairs extended and the tool ready to take a formation core.

FIG. 2B is a schematic view showing the sidewall coring tool according to this invention positioned in a bore hole and cutting a core from the formation.

DETAILED DESCRIPTION OF THE PREFERRED EMBODIMENTS

Figure 3:
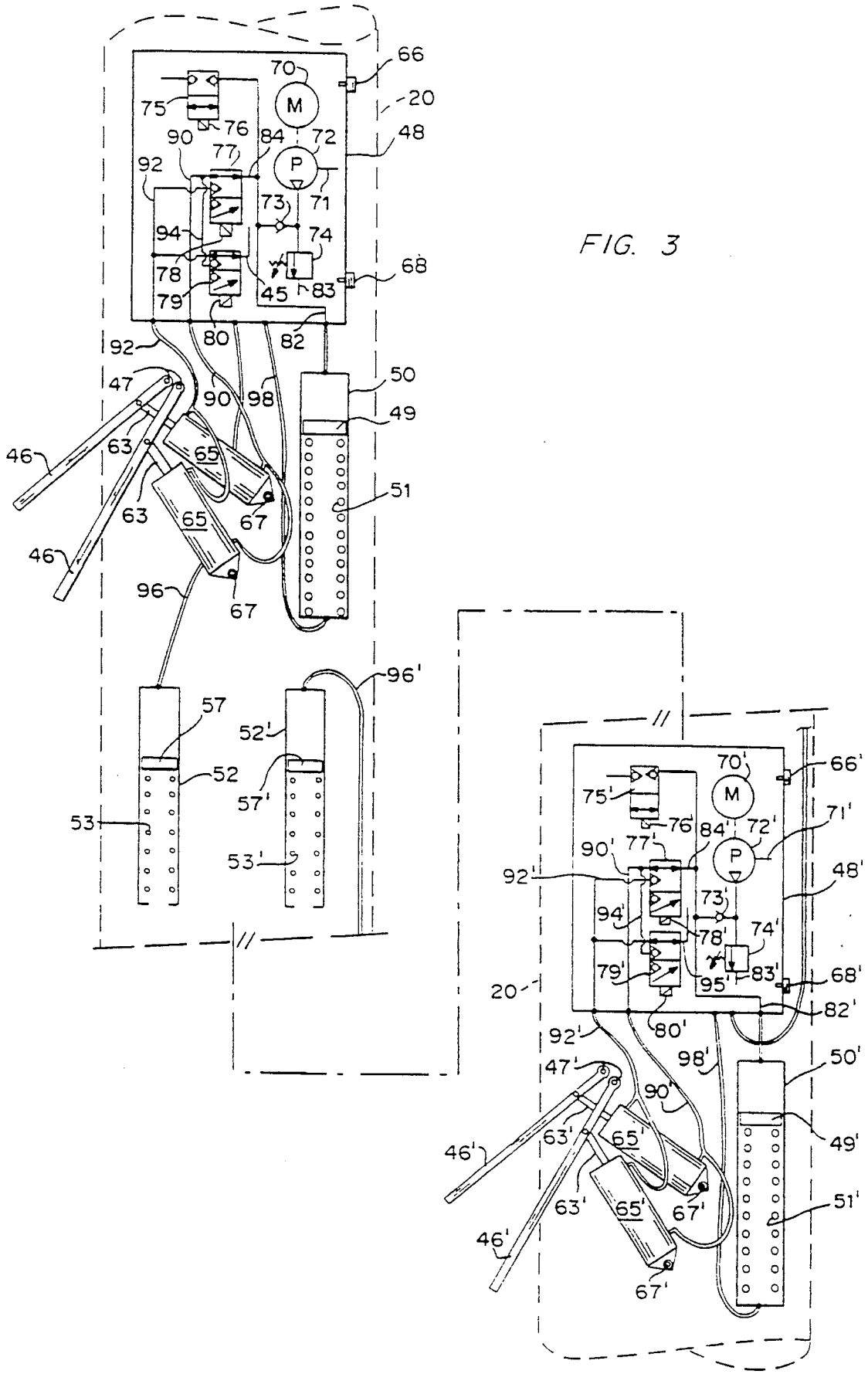
FIG. 3 is a schematic view of a portion of the mechanical apparatus of the upper and lower decentralizing locking arm pairs and a hydraulic schematic of the hydraulic system for operating the arm pairs.
Figure 4:
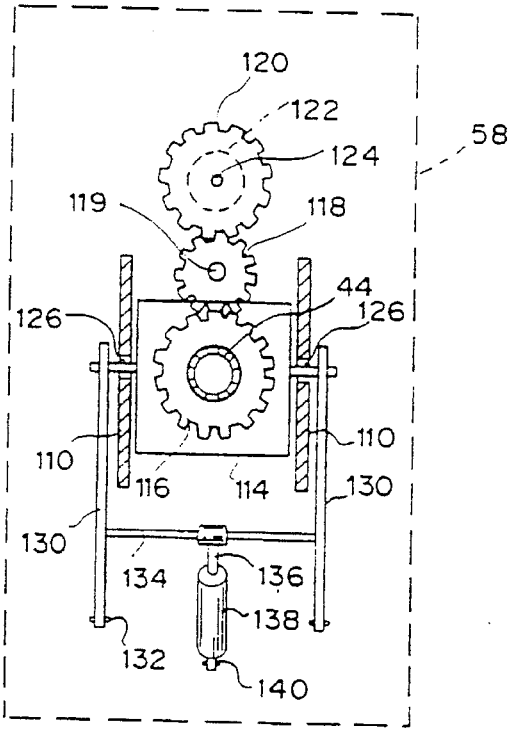
FIG. 4 is a partial front view of the rotary coring apparatus of the sidewall coring tool.
Figure 5:
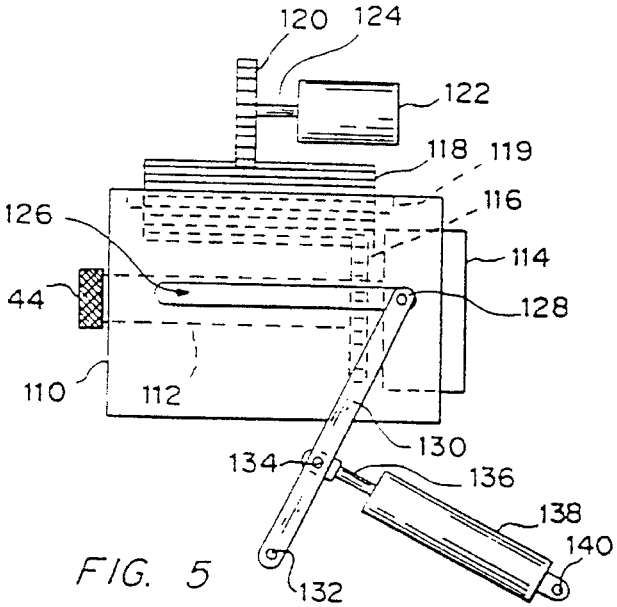
FIG. 5 is a partial side view of the rotary coring apparatus of the sidewall coring tool ready to be deployed into the formation.
Figure 6:
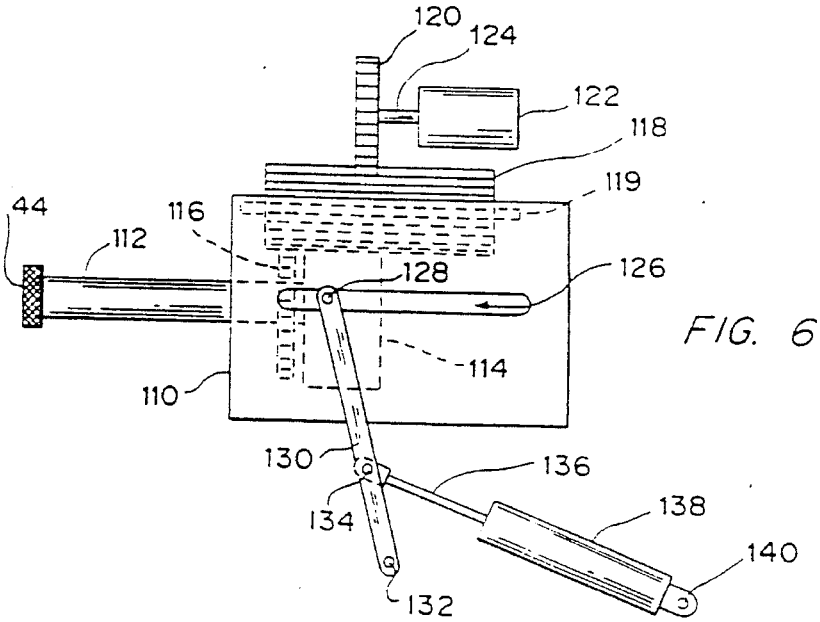
FIG. 6 is a partial side view of the rotary coring apparatus of the sidewall coring tool showing the coring bit fully deployed into the formation.

Referring now to FIG. 1, a schematic view of the rotary coring tool 20 according to the present invention is shown being lowered into an oil or gas bore hole 26, penetrating an earth formation 28, by means of a multi-conductor steel cable or wireline 22 attached to the top of the tool by a cable head connection 24. The cable 22 is raised and lowered into the bore hole by means of a sheave 30 and standard winch or hoist apparatus (not shown) located in the surface unit 32. Electrical and hydraulic control of the coring tool is accomplished through a control panel 34 that is interconnected to the tool 20 through the cable 22 by conventional means. The coring tool includes a coring bit 44 shown retracted within an opening 45 into the body of the tool 20, and upper and lower decentralizing locking arm pairs 46 and 46',respectively, located on the side of the tool generally opposite to the coring bit 44 for reasons to be hereinafter explained in greater detail.

The coring tool 20 is comprised of four major sections, an electrical or electronics section 36 in which the subsurface electrical components and circuits are located, an upper decentralizing arm pair mechanical/hydraulic section 38, a rotary coring mechanical/hydraulic section 40 and a lower decentralizing arm mechanical/hydraulic section 42. Disposed in the upper decentralizing arm section 38 and associated with the mechanical arm apparatus 46 therein is a pressure vessel 48 containing the hydraulic circuitry for the upper decentralizing arm pairs and an associated pressure accumulator tank 50. Similarly, disposed in the lower decentralizing arm pair section 42 and associated with the mechanical arm pair apparatus 46' therein is a pressure vessel 48' containing the hydraulic circuitry for the lower decentralizing arm pair and an associated pressure accumulator tank 50'. Also located in the lower arm pair section 42 are a pair of pressure accumulator tanks 52 and 52' that are used with the pressure vessels 48 and 48', respectively. The rotary coring mechanical/hydraulic section 40 includes a mechanical assembly 58 that includes the mechanical apparatus for rotationally turning the coring bit, deploying and retracting the coring bit into the formation and applying the necessary force on the bit to perform the coring function. In addition, a pressure vessel 60 contains the necessary hydraulic circuitry for actuating, driving and controlling the operation of the coring bit. A pressure accumulator tank 62 associated with the pressure housing 60 is also included in section 40.

Referring to FIGS. 1, 2A and 2B, the basic operation of the sidewall rotary coring tool 20 will be described. In FIG. 2A, the tool 20 is shown lowered in the bore hole 26 by means of cable 22 to a desired depth for obtaining a core from formation 29. When the tool is in the desired location, the operator actuates the upper and lower decentralizing arm pairs 46 and 46' from the surface control panel 34. The arm pairs 46 and 46' are pivotally extended into contact with the walls of the bore hole 26 and force the side of the tool 20 carrying the coring bit 44 into contact with, or very closely-spaced association with, the wall of the bore hole opposite from the side that contacts the extended arm pairs 46 and 46'. Each arm of the arm pairs 46 and 46' is separately extended and makes separate individual contact with the walls of the bore hole 26 in order that each arm will make decentralizing and locking contact with the bore hole wall surface regardless of the rugosity of the surface. In FIG. 2B, the coring bit 44 is shown fully deployed through the opening 45 in the body of the tool 20 into the formation for obtaining a core from the formation 29 while the tool 20 is locked in place against the wall of the bore hole 26 by arm pairs 46 and 46'. After the core is obtained, the coring bit 44 is retracted through the opening 45 into the body of tool 20 as shown in FIG. 2A and the decentralizing arm pairs 46 and 46' are also retracted into the body of tool 20 as shown in FIG. 1. The tool 20 may then be raised and removed from the bore hole 26 by means of cable 22 and the core retrieved from the tool for analysis. While not shown, a plurality of coring sections 40 carrying rotary coring assembly 58 could be included in the tool 20 for taking a plurality of core samples at different depths in the bore hole.

Referring now to FIG. 3, the construction and operation of the upper and lower decentralizing arm pairs 46 and 46' will be described in detail. Each pair of arms 46 and 46' is operated by its associated hydraulic system 48 and 48', respectively. The upper locking arm pair 46 and its associated hydraulic system disposed in pressure housing 48 also operate in conjunction with the pressure accumulators 50 and 52. Similarly, the lower locking arm pair 46' and its associated hydraulic system 48' also operate in conjunction with the pressure accumulators 50' and 52'. For simplicity, the following description of the construction and operation of a decentralizing locking arm pair will be made with respect to the upper arm pair 46, but the described construction and operation will equally apply to the lower arm pair 46'.

The pair of upper locking arms 46 are shown mounted within the body of tool 20 by pivot pins 47 and adapted for limited arcuate movement by means of a pair of hydraulic cylinders 65 attached thereto. The piston rod 63 of each cylinder is attached to one of the arms 46 below the pivot pins 47 for actuating the decentralizing locking arm pair 46. The cylinders 65 are each mounted for limited arcuate movement within the body of tool 20 by pins 67. The pressure vessel or housing 48 contains the hydraulic circuit components associated with the operation of the upper arm pair 46. The pressure housing 48 is completely filled with a suitable hydraulic fluid as will hereinafter be further explained and the housing 48 acts as the hydraulic fluid reservoir or "tank" for the hydraulic fluid used in the system. Accordingly, when reference is hereinafter made to withdrawing or applying hydraulic fluid to the "tank" it is meant that the fluid is being withdrawn or applied to the appropriate pressure housing 48, 48' or 60.

A motor 70, actuated from the surface control panel 34 as will hereinafter be further explained, has its drive shaft coupled to a hydraulic pump 72. The pump 72 receives hydraulic fluid from the tank through line 71 and pumps pressurized fluid through a check valve 73 and line 84 to one side of a solenoid valve 77, and through line 86 to one side of a solenoid valve 75. Pressurized fluid from pump 72 is also applied through line 81 to one side of a pressure relief valve 74. The other side of the pressure relief valve 74 is connected through line 83 to the tank. The other side of solenoid valve 77 has a pair of outputs applied through lines 90 and 92 to the piston ends and the discharge ends, respectively, of the arm deployment cylinders 65. One of the pair of outputs of solenoid valve 77 is applied through line 94 to one of a pair of ports on one side of solenoid valve 79. The other one of the pair of ports from solenoid valve 79 is connected by line 93 to line 92 for interconnection to cylinder 65 as above described. The downstream side of check valve 73 is also interconnected through line 82 as an input to the pressure accumulator tank 50 for purposes to be hereinafter further explained. The other end of the tank 50 is interconnected by line 98 to the pressure housing 48. The pressure housing 48 is also interconnected by line 96 to the pressure accumulator tank 52 for purposes to be hereinafter explained. As above stated, the hydraulic circuit components and operation of the pressure housing 46' are identical to the components and operation of the pressure housing 46 and will not be separately explained.

To deploy the locking arm pair 46, the motor 70 is energized and the pump 72 actuated. The hydraulic fluid flows under pressure through check valve 73, line 82 to the piston 49 side of accumulator 50, to one side of solenoid valve 75 through line 86 and through solenoid valve 77 and line 90 to the piston sides of cylinders 65. The discharge sides of cylinders 65 are connected through lines 92 and 93 through solenoid valve 79 and line 95 the tank. The pistons 63 of cylinders 65 are extended and extend the arms 46 in an arcuate motion about pivot pins 47. Once the ends of the arm pairs 46 have contacted the walls of the bore hole 26 (see FIG. 2A) their motion is limited and the continued pressure from pump 72 is applied through line 82 to the accumulator 50 where it acts against the piston 49 and compresses a coil spring 51. Once the pressure reaches a predetermined value which has been adjustably preset with respect to the pressure relief valve 74, the fluid passes through relief valve 74 and line 83 the tank. The electric motor 70 is now de-energized from the surface and the deploying cycle of the arm pair 46 is complete. Once the motor 70 and pump 72 are de-energized, the force exerted by the compression spring 51 in the accumulator 50 maintains the hydraulic pressure applied to piston 49 and through lines 82 and 84, through solenoid valve 77 and line 90 to the piston side of the cylinders 65 for locking the arms 46 in contact with the bore hole wall. In practice, it has been found advantageous to have locking and exerting forces by the arms acting against the bore hole walls that are sufficient to hold and maintain the tool body in place against the bore hole wall during the coring operation. It has been found that a force of approximately 1000 pounds per arm for each arm pair 46 and 46' is sufficient to securely hold the tool body in place.

As a safety feature, the coring tool 20 may be removed from the bore hole with the arm pairs 46 and 46' extended into contact with the bore hole wall in the event of a failure of the arm pairs 46 and 46' to retract. The tool 20 may be raised by lifting the cable 22 and the arms 46 and/or 46' will be able to move in order to accommodate any uneven features of the bore hole wall by exerting "reverse" pressure on the pistons of the cylinders 65. This "reverse" pressure is transmitted to the accumulator 50 and is applied to the piston 49 and spring 51, thus permitting the arms 46 and 46' limited arcuate movement to accommodate the rugose bore hole wall conditions and permitting the raising of the tool 20. There will be a frictional drag force acting between the side of the tool 20 in contact with the bore hole wall, but it should be overcome by the cable reeling force and the strength of the cable.

To retract the arm pairs 46, the electric motor 70 is again energized and actuates the pump 72, while the solenoid coils 78 and 80 of solenoid valves 77 and 79, respectively, are simultaneously energized. With the coils of the solenoid valves 77 and 79 energized, the hydraulic fluid flows through check valve 73 and the energized position of valve 77 and line 92 to the discharge side of the cylinders 65, and from the piston sides of cylinders 65 through lines 90 and 94 through the energized position of valve 79 and line 95 to the tank, thus retracting the piston rods 63 and the arms 46. The fluid in the accumulator 50, pushed by the force of the compression spring 51 acting on piston 49, is applied to the tank through lines 82 and 84, through the energized solenoid valve 77 and the line 90 to the cylinders 65 as hereinabove described. Once the arms 46 are retrieved inside the body of tool 20, a timing circuit (not shown) at the surface control panel 34 de-energizes the motor 70 and the two-way solenoid valves 77 and 79, and simultaneously energizes the solenoid coil 76 of the solenoid valve 75. The energizing of valve 75 permits the accumulator 50 to continue to force fluid from the accumulator through lines 82 and 86 through the energized position of valve 75 the tank until the pressure in the accumulator 50 is stabilized with the system pressure of the tank. This action maintains the arms 46 inside the body of tool 20.

In the event that there is a malfunction that prevents the energization of motor 70, thus preventing the actuation of pump 72 for operating the cylinders 65 to retract the arm pairs 46, it is still possible to partially retract the arms 46 and permit the removal of the tool 20. The solenoid coil 76 of the solenoid valve 75 can be energized, thus permitting the fluid in the accumulator 50 to be pushed by the action of the spring 51 and piston 49 through the energized position of the valve 75 to the tank through lines 82 and 86. The pressurized fluid in the piston sides of the cylinders 65 will be allowed to escape through line 90, the de-energized position of the solenoid valve 77 and lines 84 and 86 to the energized position of the solenoid valve 75 for dumping to the tank. As the pressure in the cylinders 65 decreases the arms 46 will be at least partially retrieved and permit the disengagement of the tool 20 from the wall of the bore hole 26. Any additional force exerted by the bore hole walls on the ends of the locking arms 46 as the tool 20 is removed from the bore hole will force additional fluid from the cylinders 65 through the energized solenoid valve 75 to the tank and permit additional retraction of the arms 46. As may be seen from the above description, the accumulators 50 and 50' function to keep the arm pairs 46 and 46' locked against the walls of the bore hole and to assist in retracting the arm pairs 46 and 46', either in the normal mode with the operation of pumps 72 and 72', or in a failure mode as above described.

FIGS. 4–7 show various aspects of the mechanical construction and operation of the coring bit assembly 58 (see FIG. 1) and especially the drive train and transmission for imparting the low speed and high torque needed for drilling hard rock and which will allow the maximum extension of the coring bit into the formation with respect to the diameter of tool 20. The coring bit 44 is mounted on the end of a cylindrical mandrel 112 which is in turn has its opposite end mounted for rotation in a thrust block 114. The thrust block 114/mandrel 112/coring bit 44 combination is mounted for lateral movement with respect to the axis of the tool 20 between a pair of side mounting plates 110, each of which have laterally disposed slots 126 extending through a portion thereof. Thrust block 114 has a pair of laterally extending pins 128 that extend through the slots 126 of side plates 110 for permitting lateral movement of the thrust block/mandrel/coring bit combination between the side plates with respect to the longitudinal axis of the tool 20.

Figure 7:
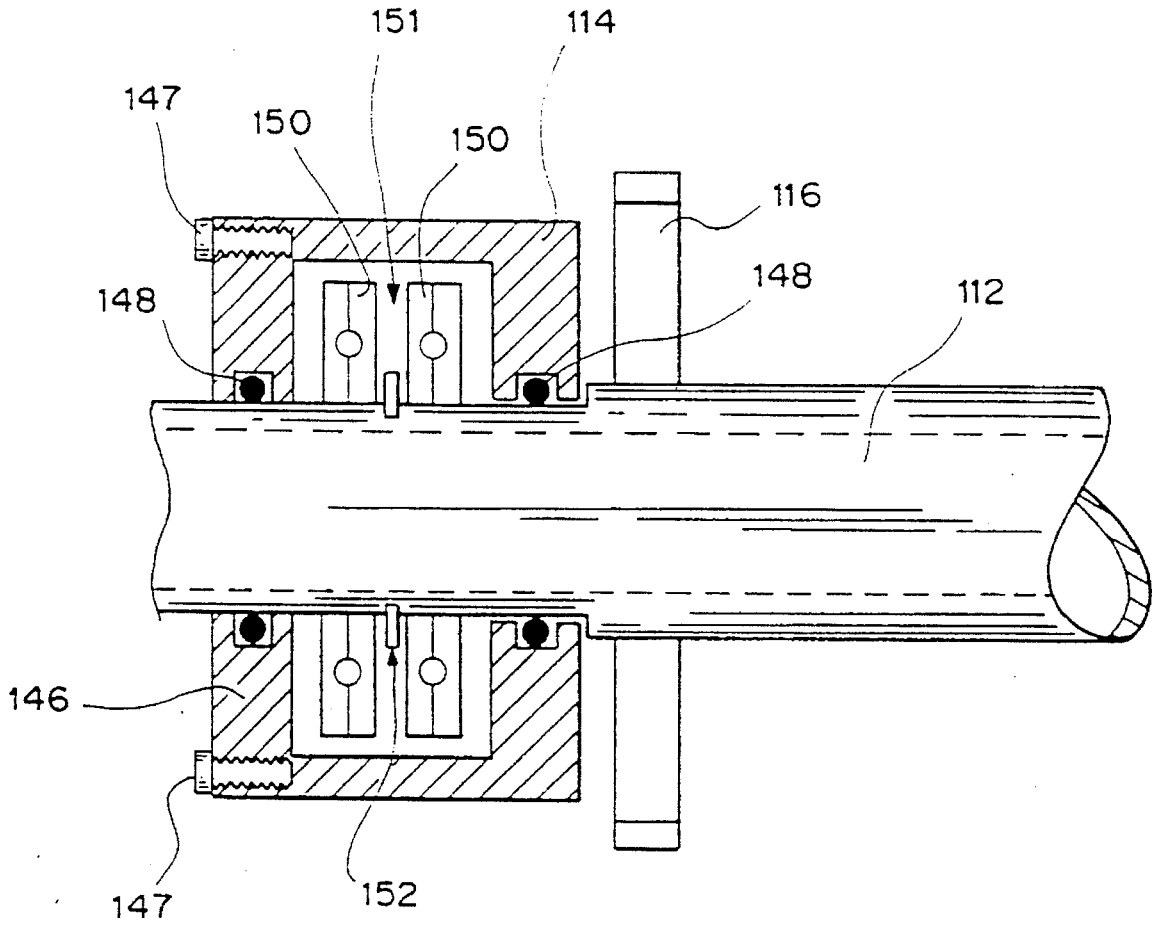
FIG. 7 is a partial cut-away view of the mating of the coring bit mandrel and the thrust block for permitting rotary motion of the mandrel while the block is moved laterally.

The mandrel 112 is mounted for rotation within the thrust block 114 as shown in FIG. 7. The block 114 has a centrally disposed circular recess 151 for accepting a pair of thrust bearing assemblies 150. The thrust block 114 has a cavity 151 accepting the pair of thrust bearings 150 and a cover 146 is retained in place by means of conventional fasteners, such as a plurality of bolts 154. A spring ring 152 is disposed in a groove in the outer surface of mandrel 112 for separating the pair of bearing assemblies 150. The spring ring 152 also functions to maintain both bearing assemblies in position to accept thrust in the axial direction of the mandrel, either when the coring bit 44 is advanced into the formation 29, or when the bit 44 is retracted from the formation as will be hereinafter further explained. The cavity 151 in the thrust block 114 is filled with oil and sealed within the cavity by seals 148 disposed between the surface of the mandrel 112 and the thrust block 114.

The mandrel 112 is a hollow cylinder for accepting the drilled core sample and retains the core sample during the retracting operation of the coring bit 44. The size of the core sample that the present invention allows is substantially larger than conventional sidewall core samples now obtainable. Conventional sidewall rotary cored samples are rather small, having a length of 1.6 in. and a diameter of 0.9 in. The rotary coring apparatus of the present invention permits the taking of "large" sidewall core samples, which is defined as samples that exceed the above described conventional 1.6 in.×0.9 in. size. This sidewall rotary coring apparatus can obtain large cores of the size 6.0 in. in length and 1.5 in. in diameter in a tool having a body diameter of only 9 in.

A pair of link arms 130 have one end attached to the extending pins 128 and the other ends of arms 130 are mounted for limited pivotal movement at 132. A cross arm 134 is disposed between the arms 130 and has attached thereto the extending piston arm 136 of a hydraulic cylinder 138, which is mounted for limited pivotal movement at 140. Operation of the piston rod 136 of the cylinder 138 will pivot link arms 130 and drive the thrust block/mandrel/coring bit 44 combination as the pins 128 of the thrust block 114 are guided laterally by the slots 126 in the side plates 110.

The drive and transmission arrangement that permits the mandrel 112 and coring bit 44 to rotate while the thrust block 114 is moved laterally will now be described. The gear 116 in mounted concentrically on mandrel 112 adjacent the end mating with the thrust block 114. Disposed above the mandrel 112 and in parallel longitudinal axial alignment therewith is a an idler pinion gear 118 adapted for rotation about axial shaft 119. The mandrel gear 116 is in constant engagement with the idler pinion gear 118, and since the axes of the mandrel 112 and the pinion gear 118 are longitudinally aligned in parallel, the mandrel gear 116 may move longitudinally with respect to the idler pinion gear 118 during rotation. The pinion gear is driven by a drive gear 120 mounted above the pinion gear 118, the drive gear 120 being driven by a suitable hydraulic motor 122 via drive shaft 124.

The drive motor 122 is a high torque, low speed hydraulic motor which remains stationary and does not have to move along with the thrust block/mandrel/coring bit combination during deployment into the formation. An orbit hydraulic motor was selected for use as drive motor 122, however, any other suitable drive motor may be selected if it delivers the low speed and high torque necessary for the coring operation. Since the drive motor 122 is remotely located, the size of the motor can be larger that if it was attached axially to the coring bit mandrel 112. Locating the drive motor 122 off-axis of the coring bit mandrel 112 also allows the coring mandrel 112 to be almost as long as the diameter of the coring tool 20, thus permitting cutting and retrieval of a longer core sample. Other gearing arrangements may be employed between the drive gear 120 and the motor 122 for gearing up or down the drive speed imparted to the drive gear 122. The combination of the main drive gear 120, the pinion gear 118 and the mandrel gear 116 forms a low speed high torque transmission between the remote drive motor 122 and the coring mandrel 112 that rotationally drives the coring mandrel 112. The transmission also permits the longitudinal axial movement of the coring mandrel 112 for deploying the coring bit 44 into the formation using the link arms 130/cylinder 138 operation as above described. The low speed high torque transmission and/or motor arrangement permits the coring bit 44 to drill in extremely hard rock formations such as granite.

Figure 8:
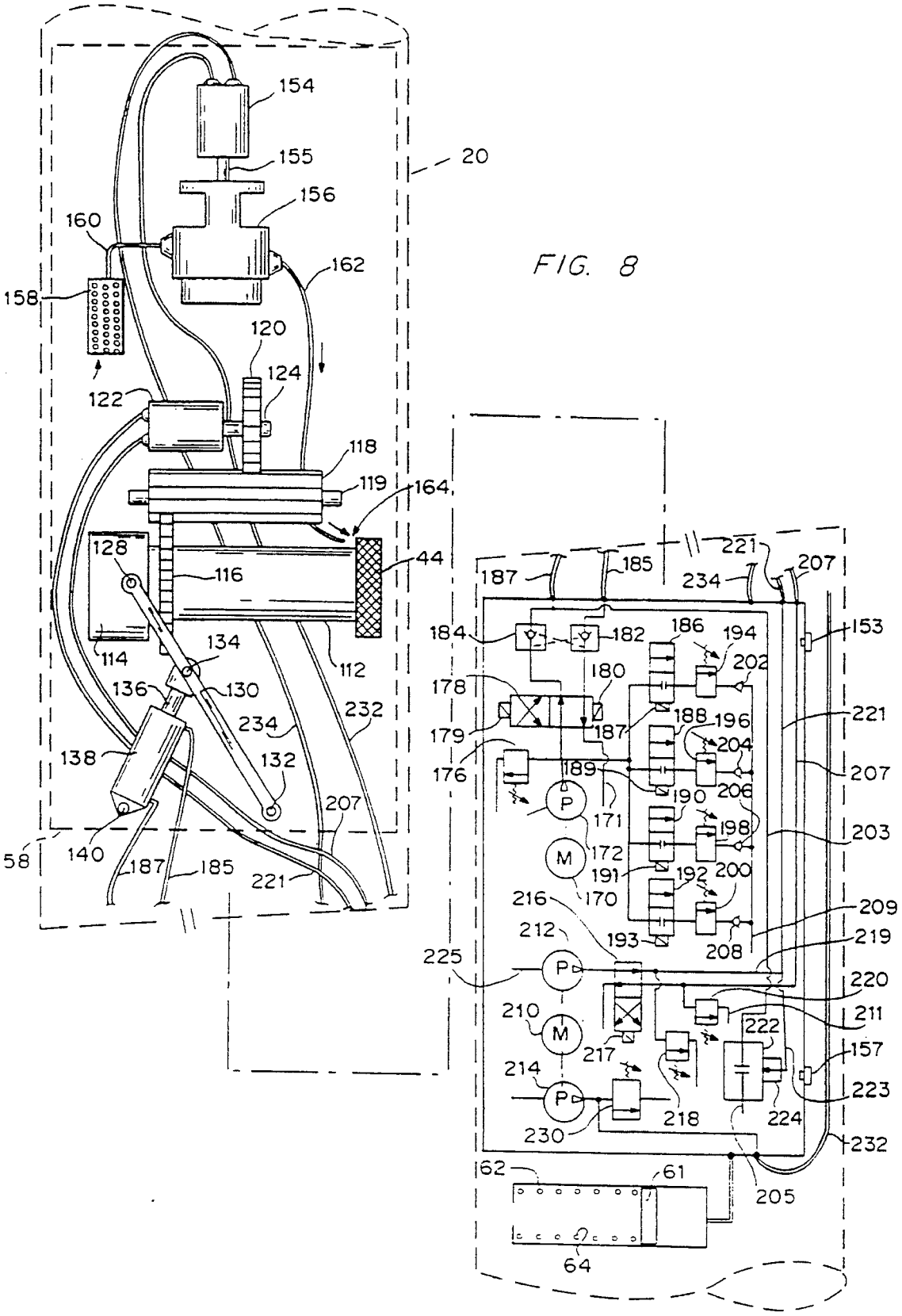
FIG. 8 is a schematic view of the rotary coring apparatus and a hydraulic schematic of the hydraulic system for operating the rotary coring system.

The mechanical and hydraulic system for rotationally driving and deploying and retracting the coring bit mandrel 112 and the coring bit 44 is shown in FIG. 8. The mechanical thrust block 114/mandrel 112/coring bit 44 assembly shown at 58 (see FIG. 1) and as described above with respect to FIGS. 4–7 is shown schematically in FIG. 8, including the drive link arms 130 and the thrust drive cylinder 138. The mandrel gear 116, the pinion gear 118, the main drive gear 120 and drive motor 122 are also shown. In addition, a second hydraulic motor 154 is connected to and drives a water pump 156 via a drive shaft 155 for purposes to be hereinafter further described. The input port of the pump 156 is connected to a fluid filter 158 by line 160. The output port of the pump 156 is connected to a line 162 that terminates adjacent the mandrel 112/coring bit 44 interface.

A pressure vessel or housing 60 is disposed adjacent the mechanical coring bit assembly 58 and contains the hydraulic circuit components for operating the coring bit assembly. A motor 170 is mechanically coupled to a hydraulic pump 172 which pumps hydraulic fluid under pressure from the tank and delivers the pressurized fluid to one side of a pressure relief valve 176, one of a pair of input ports on one side of a solenoid valve 178, and to one side of solenoid valves 186, 188, 190 and 192. The other input port on one side of solenoid valve 178 is interconnected through lines 171 and 225 to the tank. A pair of output ports of the solenoid valve 178 are connected to the inputs of a pair of pilot check valves 182 and 184. The output sides of the pilot check valves 182 and 184 are connected through lines 185 and 187, respectively, to the discharge side and the piston side, respectively, of the coring thrust cylinder 138. The output ports of each of the solenoid valves 186, 188, 190 and 192 are connected to one side of respective pressure relief valves 194, 196, 198 and 200. The other sides of each of the pressure relief valves 194, 196, 198 and 200 are interconnected to one side of respective check valves 202, 204, 206 and 208, the other sides of which are all connected through lines 209 and 225 to the tank. The above components of the hydraulic system operate the deployment of the coring bit 44 into the formation and will adjust the thrust coring pressure exerted on the coring bit as will be hereinafter explained.

Housing 60 also includes a second motor 210 which has a pair of axial shafts mechanically interconnected to and driving a pair of hydraulic pumps 212 and 214. Pump 212 pumps pressurized fluid from the tank line 225 to one side of a solenoid valve 216. One output port of the solenoid valve 216 is interconnected through lines 219 and 221 to one input port of the coring drive motor 122, to one side of a pressure relief valve 218 and to the pilot side 224 of a sequence valve 222 through line 223. The other side of the pressure relief valve 218 is connected through lines 217, 215 and 225 to the tank. One side of the sequence valve 222 is interconnected to the output side of the pilot check valve 184 through line 203. The other side of the sequence valve 222 is connected to the tank through lines 205, 215 and 225. The other output port of the solenoid valve 216 is interconnected through line 207 to the other input port of the coring drive motor 122, and to one side of a pressure relief valve 220. The other side of pressure relief valve 220 is interconnected to the tank through lines 211, 215 and 225. The other pump 214 delivers pressurized fluid to one side of a pressure relief valve 230 and through line 232 to one input port of the motor 154. The other input port of the motor 154 in interconnected to the tank through line 234. The other side of the pressure relief valve 230 is connected back to the tank by interconnection to line 215. An accumulator tank 62 is connected to the pressure housing 60 through a line 236.

Figure 9:
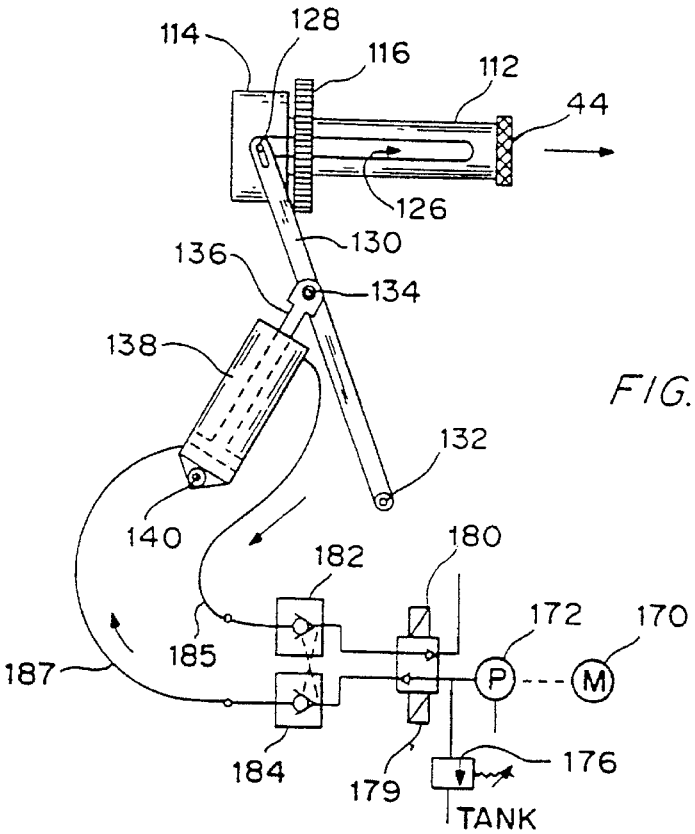
FIG. 9 is a partial schematic of the rotary coring apparatus and associated hydraulic system showing the deployment operation of the rotary coring tool.

The advance coring cycle will now be described with reference to FIGS. 8 and 9. The electric motor 170 is energized from the surface control panel 34 and actuates pump 172, and the solenoid coil 180 of the four-way solenoid valve 178 is energized. The pump delivers pressurized fluid to the energized position of valve 178 as shown to the pressure relief valve 184 and to the piston side of cylinder 138 via line 187. This action extends the piston rod 136 which in turn pivots the link arms 130 which pivot around points 132 and exert force on pins 128 of the thrust block 114. The force exerted on the thrust block 114 pushes the thrust block/mandrel/coring bit combination laterally as the pins 128 slide in the slots 126 and forces the coring bit 44 into the formation to be cored. The fluid on the discharge side of cylinder 138 flows through line 185, pilot check valve 182 (now maintained in an open condition by the pressure in pilot check valve 184), through the solenoid valve 178 to the tank.

Figure 10:
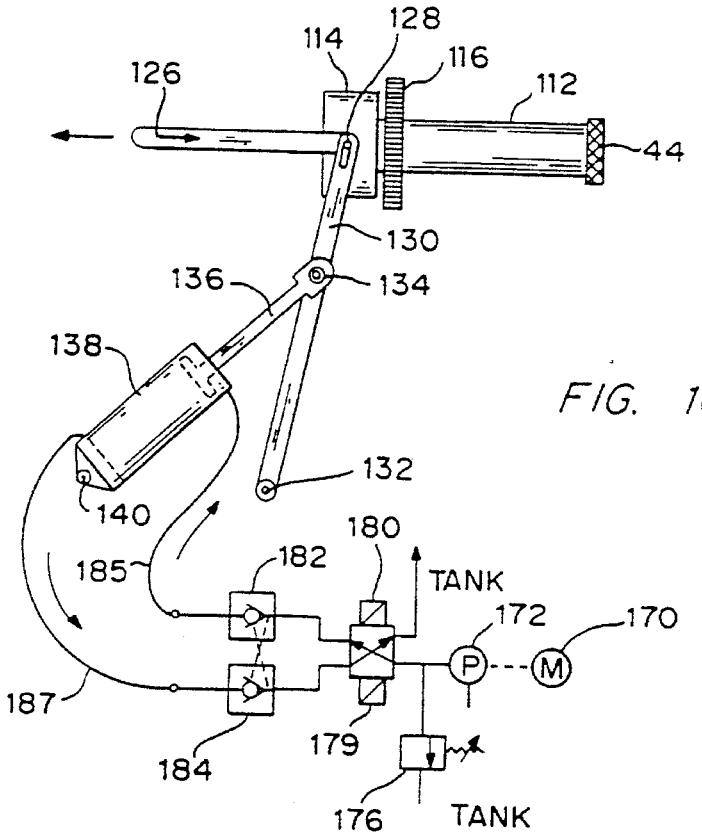
FIG. 10 is a partial schematic of the rotary coring apparatus and associated hydraulic system showing the retraction operation of the rotary coring tool.

The retract coring cycle will now be described with reference to FIGS. 8 and 10. With the motor 170 energized and actuating pump 172 and the solenoid coil 179 of the four-way solenoid valve 178 energized, the pump 172 delivers pressurized fluid through the energized position of the valve 178 through check valve 182 to the piston rod side of the cylinder 138 through line 185. The piston side of cylinder 138 is connected through line 187 through the pilot check valve 184 (now maintained in an open condition by the pressure in pilot check valve 182) through the solenoid valve 178 to the tank. Applying the pressure to the piston rod side of the cylinder 138 pushes the cylinder piston back into the cylinder and retracting the piston rod 136. This action of piston rod 136 pivots the link arms 130 in the reverse direction and exerts retracting forces on the pins 128 and the thrust block 114. The forces acting on the thrust block 114 move the thrust block/mandrel/coring bit combination laterally as the pins slide in the slots 126, thus retracting the coring bit 44 from the formation back into the body of tool 20.

The pressure applied to the cylinder 138 for applying the advance-retract pressure on the coring bit 44 may be selectively controlled from the surface. Referring now to FIG. 8, the selection control will be explained. When motor 170 is energized from the surface as previously described, the pressurized fluid is also applied to one side of the solenoid valves 186, 188, 190 and 192. If the solenoid coils 187, 189, 191 and 193 of the solenoid valves 186, 188, 190 and 192 are not actuated, the pressurized fluid is applied to the pressure relief valve 176. When the pressure reaches the by-pass pressure preset into the valve 176, the fluid will flow through the pressure relief valve 176 to the tank. In practice, the preset pressure at which the pressure relief valve is set is the maximum pressure that is desired in the advance-retract circuit and which is applied to the cylinder 138. The preset pressure of the pressure relief valve 194 can be adjusted to a pressure value that is the minimum pressure that is desired in the advance-retract circuit and which will be applied to the cylinder 138. Similarly, the preset pressure of the pressure relief valves 196, 198 and 200 may be set at selected intervals between the maximum pressure set for valve 176 and the minimum pressure set for valve 194. Accordingly, if coil 187 of the solenoid valve 186 is energized from the surface, the pressurized fluid will be applied through valve 186 to the pressure relief valve 194. When the pressure reaches the preset minimum value, the pressure relief valve 194 will allow the pressurized fluid to flow through the valve and the check valve 202 to the tank. Similarly, by selectively energizing one of the coils 189, 191 and 193 of the solenoid valves 196, 198 and 200, respectively, the pressurized fluid will be applied to one of the respective pressure relief valves 204, 206 and 208. When the preset pressure is reached at the respective associated pressure relief valve, the pressure relief valve 196, 198 or 200 will permit the flow of the fluid through the respective check valves 204, 206 and 208 to the tank, thus limiting the advance-retract circuit hydraulic pressure to the preset pressure of the selected solenoid valve/pressure relief valve combination 186/194, 188/196, 190/198 and 192/200. By choosing increasing or decreasing preset pressure values of the pressure relief valves 194, 196, 198 and 200, the operator at the surface has a choice of forces for applying to the coring bit 44 as transmitted by the thrust force cylinder 138.

The mandrel 112 and coring bit 44 combination may be rotated in either a clockwise (CW) direction for coring in the formation or in a counterclockwise direction (CCW) for other purposes if desired. Referring to FIG. 8, the selected operation of the drive motor 122 for rotating the coring bit 44 will be explained. When it is desired to perform the coring (drilling) operation, motor 210 is energized from the surface and actuates hydraulic pump 212. Pump 212 applies pressurized fluid through the two-way solenoid valve 216 in its de-energized position and through lines 219 and 221 to the motor 122 which will drive the mandrel 112/bit 44 combination through the transmission assembly of gear 120, pinion 118 and the mandrel gear 116 in a CW direction while the mandrel/bit combination is being advanced into the formation as hereinabove described. The pressurized fluid is also applied to the pressure relief valve 218 and will allow the pressurized fluid flow to be diverted to the tank should the bit 44 get stuck in the formation and stop its rotational motion and prevent the motor 122 from turning. The flow return from the motor 122 through line 207 and through the de-energized solenoid valve 216 to the tank via lines 211, 215 and 225.

It may happen that the coring bit 44 becomes stuck in the formation and cannot be withdrawn. The decision may be made to abandon the coring bit 44 in the formation and retrieve only the mandrel 112 into the body of the tool 20. The coring bit 44 can be unscrewed from the end of the mandrel 112 if the rotation of the mandrel is reversed and rotated in a CCW direction. With the motor 210 energized and the pump 212 actuated, and the solenoid coil 217 of the solenoid valve 216 energized, the pump will apply the pressurized fluid through the energized position of the valve 216, which reverses the oil flow to the motor 122 by sending the pressurized fluid through line 207 to motor 122. The motor will now turn in the CCW direction. Fluid from the motor 122 flows through line 221, through solenoid valve 216 and lines 211, 215 and 225 to the tank. The pressurized fluid is also applied to the pressure relief valve 220 in order to divert the fluid flow to the tank in the event the bit 44 stays stuck in the formation and does not unscrew from the mandrel 112, thus preventing the motor 210 from turning which could damage the motor.

Figure 11:
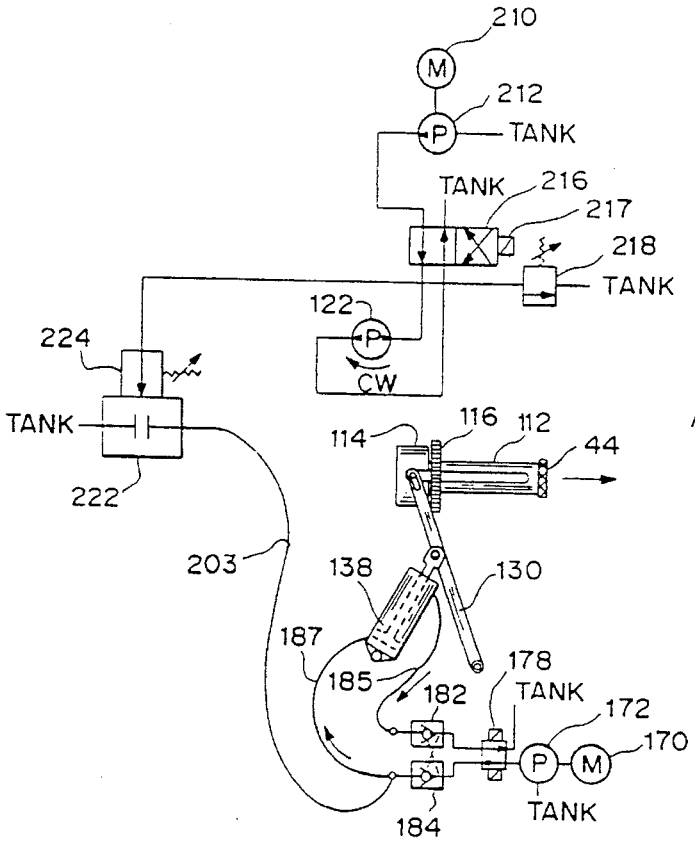
FIG. 11 is a partial schematic of the rotary coring apparatus and associated hydraulic system showing the application of automatic force on the coring bit in a normal operating mode.
Figure 12:
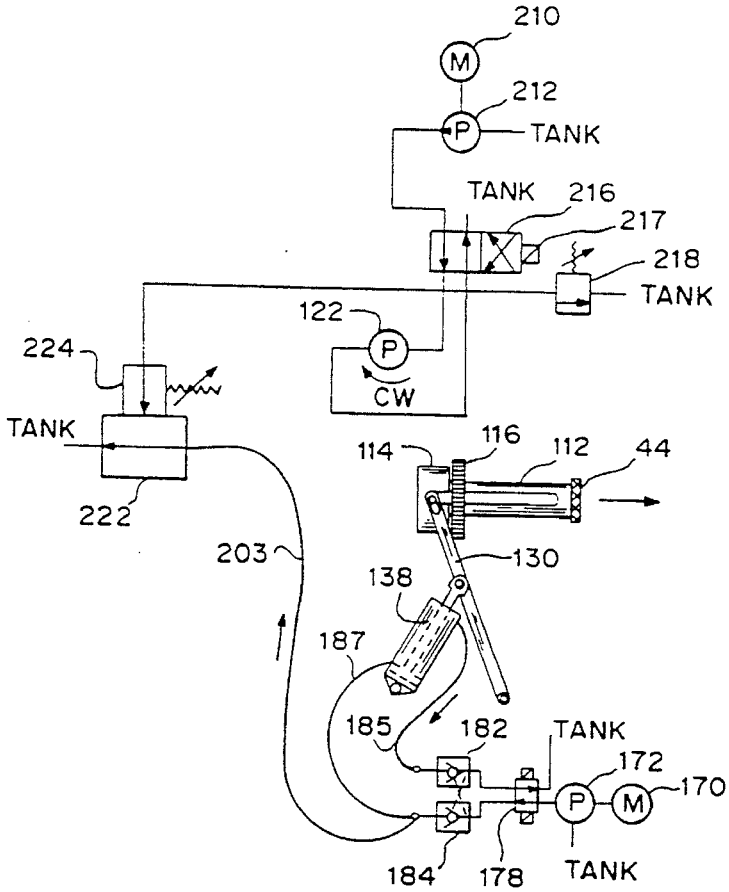
FIG. 12 is a partial schematic of the rotary coring apparatus and associated hydraulic system showing the application of automatic force on the coring bit when the bit rotation stalls.

As above described, if the force on the coring bit 44 is too high, the bit may get stuck and stop its rotation and the circuit must then bypass the motor 122. On the other hand, if the force applied to the coring bit 44 is too low, the coring bit will not penetrate the formation. Ideally, the force applied to the coring bit (the "bit load") should be constantly adjusted for the optimum drilling (coring) conditions. Making such adjustments on a constant basis during the coring operation is almost impossible to manually control from the surface. Accordingly, an automatic system has been incorporated to accomplish this constant adjustment to compensate for the drilling (coring) conditions. The description of this automatic force adjustment operation will be described with reference to FIGS. 8, 11 and 12. In a normal coring mode with force applied to the coring bit 44, the drive motor 122 is driven in the CW direction as above described, and the pressurized fluid from pump 212 is also applied to the pilot side 224 of a sequence valve 222. If the pressure applied to the pilot side 224 is lower than a preset pressure value, there will be no communication through the sequence valve 222 via line 203 (see FIG. 11) and the full pressure of the fluid is applied to the thrust cylinder 138 as hereinabove described. This is the normal mode for operating the advancing coring cycle.

However, in the event the coring bit encounters a drilling condition in the formation where the torque provided to hydraulic motor 122 by the hydraulic pump 212 is too low, the bit may reach a point where it is about to stall in the formation. When this condition occurs, the fluid pressure from the pump 212 as applied to the pilot side 224 of the sequence valve 222 increases. When the pressure at the pilot side 224 exceeds the preset pressure value of the pilot side 224, the sequence valve 222 will be actuated to permit fluid flow through line 203 to the tank from the pilot check valve 184 (see FIG. 12) and divert the pressurized fluid flow from piston side of the cylinder 138, thereby canceling the force applied to the coring bit 44 and allowing it to resume free rotation. When this occurs, the fluid pressure from pump 212 as applied to the pilot side 224 of the sequence valve 222 will again decrease below the preset pressure value and the sequence valve will be de-actuated to interrupt fluid flow through line 203 to the tank, thereby permitting pressure to be applied to the cylinder 138 which in turn will apply force to the coring bit 44 as hereinabove described and the bit 44 penetrates the formation (see FIG. 11). In this way the force applied to the coring bit will automatically be a maximum or canceled in direct response to the drilling (coring) conditions in the formation.

As the coring bit 44 penetrates the formation, rock cuttings and debris are generated that can interfere with the coring operation of the bit. This is particularly true since the coring bit 44 and mandrel will penetrate several inches into the formation and the accumulation of cuttings and debris will cause frictional drag and wear on the bit 44 and in some cases may cause it to stall in the formation. To avoid such problems, a water pump 156 is provided for pumping pressurized water from the bore hole into the drilled (cored) hole for flushing the cuttings and debris from the hole. The motor 210, as previously described, also drives a second pump 214 disposed within the pressure housing 60 which applies pressurized fluid from the tank to one input port of a hydraulic motor 154 through line 234. The other port of motor 154 is connected to the tank 60 by line 232. The drive shaft 155 of motor 154 mechanically drives the water pump 156 for actuating the pump. Water in the bore hole is applied through the filter 158 and line 160 to the input port of the water pump 156. The output port of the water pump 156 is connected through line 162 to a nozzle end disposed closely adjacent the mandrel 112 and coring bit 44 interface. The nozzle end of the line 162 applies a jet stream of pressurized water along the mandrel 112 as it penetrates the formation to flush out the cuttings and debris from the cored hole and the coring bit 44. A pressure relief valve 230 is connected to the output of pump 214 in order to divert the pressurized fluid to the tank in the event any obstruction should cause the hydraulic motor 154 to cease rotating.

Each of the pressure vessels or housings 48, 48' and 60 are pressure compensated to sustain the variations in the bore hole pressure as the coring tool 20 is lowered or raised in the bore hole. At the surface each of the housings 48, 48' and 60 are initially filled with hydraulic fluid or oil through filler inlets 66, 66' and 153, respectively, while air is allowed to escape through vent holes 68, 68' and 157, respectively. When no more air escapes from the housings 48, 48' and 60, the vent holes 68, 68' and 157 are closed and fluid is pumped by conventional means (not shown) through the filler inlets 66, 66' and 153, respectively, which causes some of the fluid to start to fill the spring accumulators 52, 52' and 62, respectively. Once the pistons 57, 57' and 61 of the accumulators 52, 52' and 62, respectively, have moved a few inches against the pressure of the compression springs 53, 53' and 64, respectively, the application of pressurized fluid is stopped. The filler inlets 66, 66' and 153 of housings 48, 48' and 60, respectively, are closed sealing each housing. The housings 48, 48' and 60 are now balanced and changes in the bore hole pressure will act on the accumulators 52, 52' and 62, respectively, to maintain the pressure within the housings the same as the pressure in the bore hole.

Figure 13:
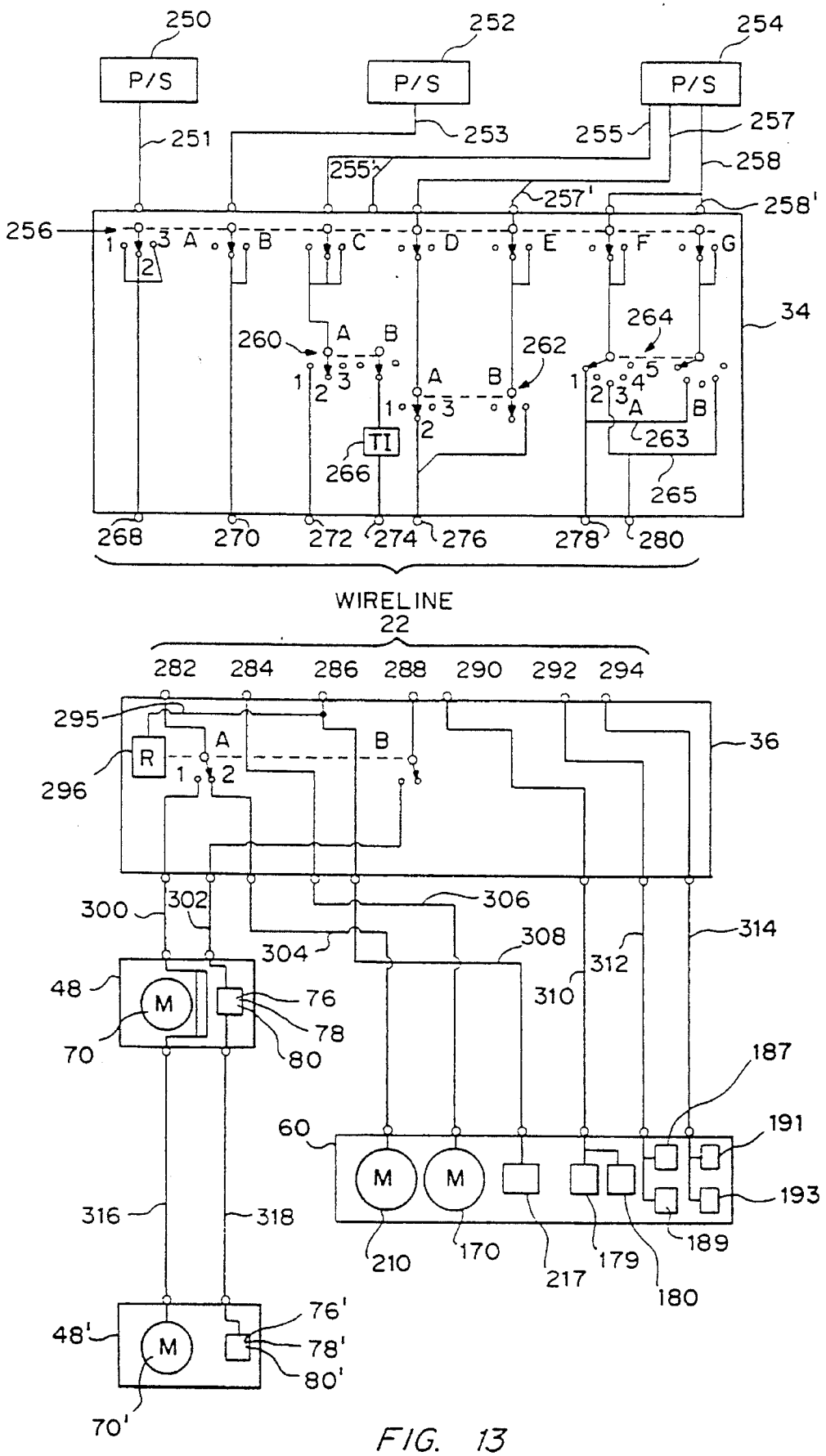
FIG. 13 is an electrical block diagram schematic of the surface control and the subsurface tool electrical control circuits for the rotary coring tool.

The electrical control and monitoring of the coring bit 44 travel will be described with reference to FIGS. 13, 14 and 15. Referring now to FIG. 13, the basic electrical controls are shown in a block diagram schematic form. Power supplies 250, 252 and 254 and control panel 34 are located on the surface, and are interconnected to the tool electrical panel 36 downhole through the wireline cable 22. Power supply 250 provides power to the electric motors 70 and 70' in the pressure housings 48 and 48', respectively, for actuating the arm pairs 46 and 46', respectively, as hereinabove described. Electrical power from power supply 250 is applied to the surface control panel 34 through section A of ganged switch 256 (in the switch position 1), panel contact 268, the wireline cable 22, contact 282 of the downhole electrical assembly 36, relay 296 contact set A (in contact position 1), electrical conductor 300 to motor 70 located in the pressure housing 48 associated with the upper decentralizing arm pair 46, and via electrical conductor 316 to the motor 70' located in the pressure housing 48' associated with the lower decentralizing arm pair 46'. The coil of relay 296 is energized by power supply 254 through the following electrical path: electrical conductor 255 to switch 256 section C (in switch position 1), through ganged switch 260, section A (in switch position 1), contact 272, wireline cable 22, contact 286 of the downhole circuit 36 and then via conductor 295 to the coil of relay 296. When the arm pairs 46 and 46' are completely extended and the tool 20 is locked against the bore hole wall (see FIGS. 2A and 2B), the current supplied by power supply 250 increases which can be monitored by a meter on the panel 34 (not shown) and the operator will then manually shut off the power from the power supply 250.

When it is desired to retract the arm pairs 46 and 46', power supply 250 is turned on and energizes motor 70 and 70' in the same manner as hereinabove described. relay 296 is also energized in the same manner as described above In housings 48 and 48', the solenoid coils 76, 78 and 80 and 76', 78' and 80' of the two-way solenoid valves 75, 77 and 79 and 75', 77' and 79', respectively, are energized through the following electrical path: power supply 254, conductors 255 and 255', switch 260 section B (in switch position 3), a conventional timing circuit 266, panel contact 274, wireline cable 22, contact 288 of assembly 36, relay 296 section B (in contact position 1), conductor 302 and conductor 318. The solenoid coils 76 and 76' of solenoid valves 75 and 75' are energized for a predetermined period of time by the timing circuit 266 after the motors 70 and 70' have been shut off, thus ending the locking arm retraction cycle.

To advance the coring bit 44, the power supply 252 energizes motor 170 located in the pressure housing 60 through the following electrical path: conductor 253, switch 256 section B (in switch position 2), panel contact 270, wireline cable 22, contact 284 on the downhole circuit 36 and conductor 306 to the motor 170. The solenoid coil 180 associated with solenoid valve 178 disposed in housing 60 directs the fluid flow through valve 178 in the proper direction to advance the coring bit 44 laterally into the formation as hereinabove described. The coil 180 is energized through the following electrical path: power supply 254, conductor 257, switch 256 section D (in switch position 2), ganged switch 262 section A (in switch position 2), panel contact 276, wireline cable 22, contact 290 of circuit 36 and conductor 310 to coil 180 of solenoid valve 178.

In retracting the coring bit, the motor 170 is energized in the same manner as above described. However, this time the coil 179 associated with solenoid valve 178 is energized instead of coil 180 to reverse the flow of the hydraulic fluid through the solenoid valve 178. The electrical path from the power supply 254 to coil 179 uses current of opposite polarity for actuating the retract sequence of the coring bit 44 through the following electrical path: power supply 254, conductors 257 and 257', section E of switch 256 (in switch position 3), switch 262 section B (in switch position 3), panel contact 276, wireline cable 22, contact 290 of circuit 36 and conductor 310 to solenoid coil 179.

During coring the coring bit drive motor 122 is actuated to drive the coring mandrel 112 and bit 44 in a CW direction for the coring (drilling) operation. The motor 210 disposed in the pressure housing 60 is energized by the power supply 250 through conductor 251, switch 256 section A (in switch position 2), panel contact 268, wireline cable 22, assembly 36 contact 282, relay 296 section A (de-energized in contact position 2), conductor 304 and motor 210. However, to rotate the coring bit drive motor 122 in the opposite direction for driving the coring mandrel 112 and coring bit 44 in a CCW direction, the electrical path for energizing the motor 210 is identical to that above described, except that the coil 217 of solenoid valve 216 is now energized by using a different current polarity and reverses the flow of fluid to the motor 122.

As hereinabove explained with regard to FIG. 8, the hydraulic pressure applied during the coring bit advance or retract function may be adjusted from the surface to allow for drilling conditions. The following solenoid valve/pressure relief valve combinations control four pressure settings, 186/194, 188/196, 190/198 and 192/200. The solenoid coils 187, 189, 191 and 193 control the operations of the solenoid valves 186, 188, 190 and 192, respectively. To control the solenoid coil 187, the following electrical path is followed: positive current from power supply 254, conductor 258, switch 256 section F (in switch position 2), ganged switch 264 section A (switch position 1), panel contact 278, wireline cable 22, circuit 36 contact 292 and conductor 312 to the solenoid coil 187. To control the solenoid coil 189, a negative current from power supply 254 is utilized, and the following electrical path is followed: conductors 258 and 258', switch 256 section G (in switch position 2), conductor 263 to panel contact 278, wireline cable 22, contact 292 in assembly 36 and conductor 312 to solenoid coil 189.

To energize solenoid coil 191 of solenoid valve 190, the following electrical path is followed: positive current from power supply 254, conductor 258, switch 256 section F (in switch position 2), switch 264 section A (in switch position 3),panel contact 280, wireline cable 22, circuit 36 contact 294 and conductor 314 to solenoid coil 191. Similarly, solenoid coil 193 may be controlled by negative current from power supply 254 applied through the following electrical current path: conductors 258 and 258', switch 256 section G (in switch position 2), switch 264 section B (switch position 4), conductor 265, panel contact 280, wireline 22, contact 294 of circuit 36 and conductor 314 to the solenoid coil 193.

It is important that the operator of the coring tool 20 knows at all times the position of the coring bit 44 relative to the body of the tool 20. A monitoring system has been incorporated in tool 20 that will display for the operator at the surface the position of the coring bit at all times during any operation of the tool. Referring now to FIG. 14, the downhole monitoring of the coring bit position is accomplished by monitoring the pivotal position of the link arm 130 as it pivots to advance or retract the coring mandrel 112 and coring bit 44 as hereinabove described. The arm 130 has an extension 131 that projects below the pivot point 132 and includes on its free end a geared sector 133 having a plurality of gear teeth 135 in engaging contact with a gear 137, causing the gear 137 to rotate in response to pivotal movement of the arm 130–131. The gear 137 has a pulley sprocket 129 attached thereto which also rotates with gear 137. The rotation of the pulley sprocket 129 rotates a second pulley sprocket 141 by means of an interconnecting drive belt 127. A round cam 141' is fixed to the pulley sprocket 141 and carries a projecting button 143. A plurality of microswitches 145, 147, 149, 153, 157, 159 and 161 mounted on a body 139 and are disposed in a semicircular arrangement closely spaced to the edge of the circular cam 141' and permitting the projecting button 143 to contact and activate a microswitch as the cam 141' rotates in response to the pivotal movement of link arm 130–131.

The arcuate spacing between the microswitches is selected with respect to the lateral distance travelled by the coring bit 44 such that one microswitch will be actuated after each one inch of travel of the coring bit. The body 139 is a water and pressure proof enclosure, and all of the microswitches 145, 147, 149, 153, 157, 159 and 181 are connected to the wireline cable as will be hereinafter described for interconnection to the monitoring panel at the surface.

Figure 14:
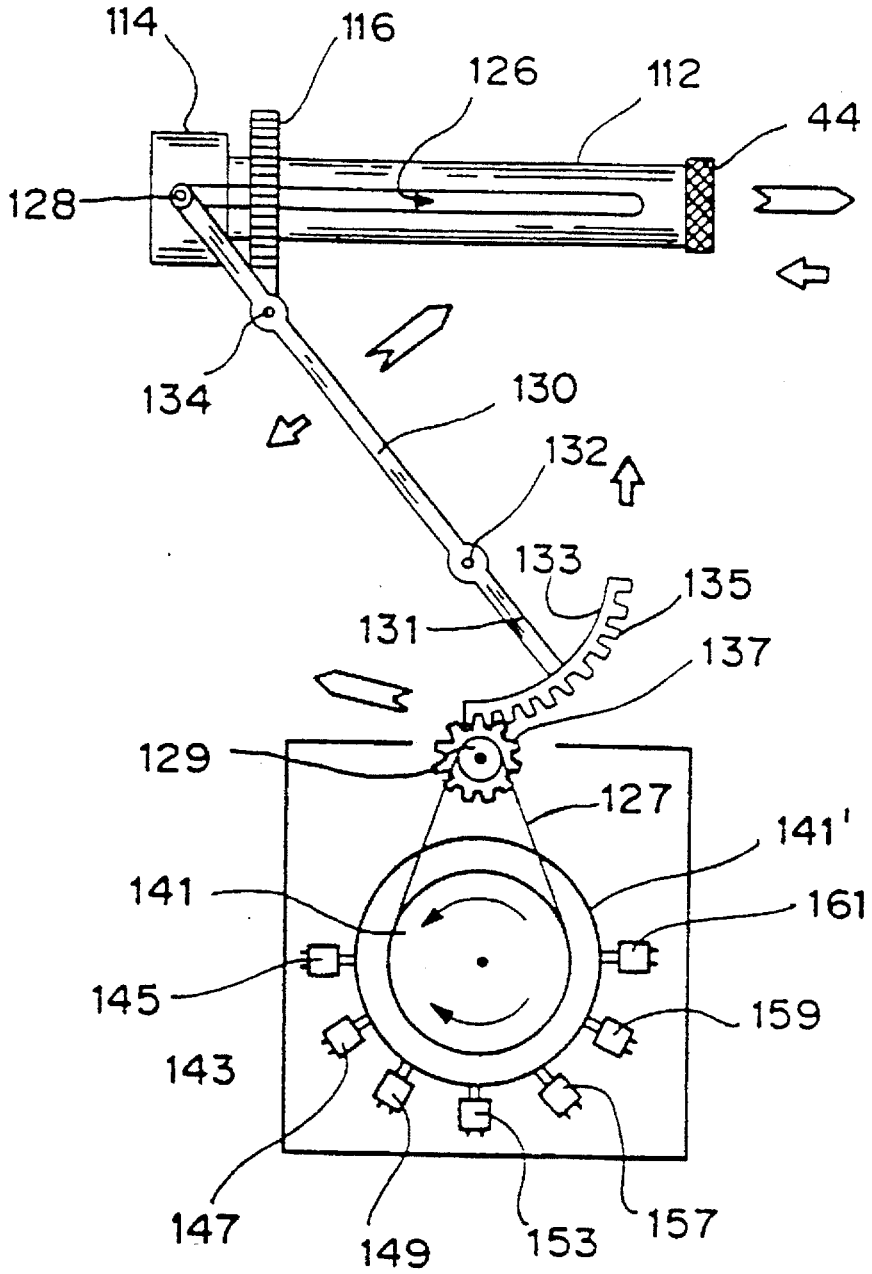
FIG. 14 is a schematic diagram of the subsurface tool mechanical and electrical apparatus associated with the deployment/retraction of the coring bit for monitoring the travel of the bit.
Figure 15:
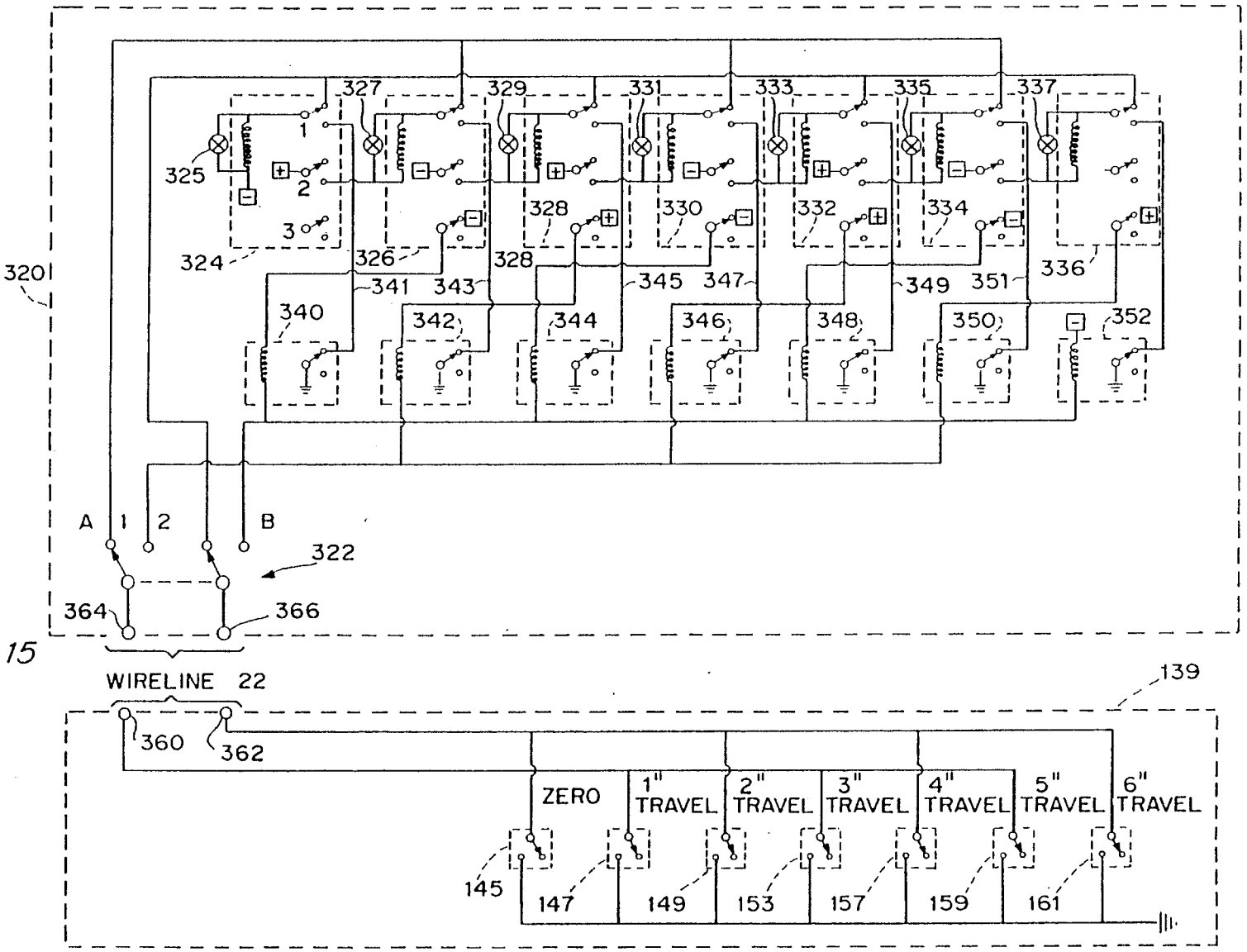
FIG. 15 is an electrical schematic, partially in block diagram form, of the surface monitoring control panel and the subsurface portion of the electrical circuit shown in FIG. 14 for monitoring the travel of the bit.

Referring now to FIGS. 14 and 15, the electrical operation of the monitoring circuit will now be explained in detail. When the coring bit 44 is fully retracted within the body of the tool 20, the cam 141' actuates the first microswitch 145. In the surface monitoring panel 320 (included within control panel 34 as shown in FIG. 1), the closing of switch 145 causes the following electrical path to be completed between the surface panel 320 and the downhole switch 145: a negative voltage from a conventional power supply (not shown) is applied to the coil of relay 324, relay contact 1, section B of ganged switch 322 (switch position 1), the panel 320 contact 366, the wireline cable 22, contact 362 of body 139 and through closed switch 145 to ground potential, thus energizing the relay 324. When relay 324 is energized, contact 1 is moved and connects the relay coil to ground potential through conductor 341 and the de-energized relay 340. The coil of relay 324 remains energized and the lamp 325 is energized to indicate ZERO travel, i.e., the bit 44 is fully retracted within the body of the coring tool 20.

As the coring bit advances into the formation, the cam 141' rotates counterclockwise (see FIG. 14) and button 143 will move away from switch 145, thus opening the switch and breaking the connection to ground. However, at the surface the relay 324 remains energized through the electrical path including the negative potential applied to the coil of relay 324, the relay contact 1, conductor 341 and the contacts of the de-energized relay 340 and the indicator light 325 remains energized. As the bit 44 continues to advance, the cam 141' continues to rotate until button 143 actuates switch 147 and closes a path to ground. The closing of switch 147 now energizes relay 326 in the surface panel 320 through the following electrical path: positive electrical potential applied to the relay 324 contact 2, the coil of relay 326, relay 326 contact 1, section A of switch 322 (switch position 1), panel contact 364, the wireline cable 22, contact 360 to switch 147 to ground. The indicator light 327 is now energized to indicate 1 INCH of bit 44 travel, since the power for lamp 327 is obtained from the energized coil of relay 326. Relay 340 remains de-energized and maintains the energization of lamp 325 and the relay coil of relay 324.

Relay 326 remains energized and the lamp 327 energized as cam 141' continues to rotate even though button 143 is no longer actuating switch 147 through the following electrical path: positive voltage applied to the contact 2 of relay 324, the coil and lamp 327 of relay 326, contact 1 of relay 326, conductor 343 and the contact of the de-energized relay 342 to ground potential. Now both lamps 325 and 327 are energized and stay energized during the advance sequence of the coring bit 44. As the bit 44 continues to advance, the cam 141' continues to rotate and sequentially actuate the microswitches 149, 153, 157, 159 and 161 in turn. The sequential actuation of the microswitches will actuate the relays 328, 330, 332, 334 and 336 in turn in the identical manner as hereinabove discussed for relays 324 and 326. When the coring bit 44 reaches its full extension it will have actuated all of the microswitches and all seven lamps 325, 327, 329, 331, 333, 335 and 337 will be energized and indicate an advance and extension into the formation of 6 INCHES travel.

After the coring bit has reached its full advance into the formation, and it is desired to retract the coring bit 44 back into the body of tool 20, the operator will move the switch 322 from its contact position 1 to contact position 2. The microswitch 161 is actuated by the button 143 of cam 141' and the relay 352 in the surface panel 320 is energized through the electrical path including the negative voltage appearing at the coil of relay 352 applied through section B of switch 322 (switch position 2) and through the switch 161 to ground. However, as soon as the cam 141' starts to rotate clockwise the button breaks contact with switch 161 and the ground connection is broken, thus de-energizing relay 352. The momentary energizing of relay 352 interrupts the ground connection to the contact 1 of the relay 336 and de-energizes relay 336, and de-energizes lamp 337 which indicates that the coring bit 44 is now retracting from its maximum advance. When the coring bit 44 retracts to the 5-inch extension, the cam button 143 will actuate the microswitch 159 which energizes relay 350 by applying positive voltage appearing at contact 3 of the de-energized relay 336 through the coil of relay 350. section A of switch 322 (switch position 2), contact 364, the wireline cable 22, panel contact 360 and through switch 159 to ground.

However, as soon as the cam 141' starts to rotate clockwise the button breaks contact with switch 159 and the ground connection is broken, thus de-energizing relay 350. The momentary energizing of relay 350 interrupts the ground connection to the contact 1 of the relay 334 and de-energizes relay 334, and de-energizes lamp 335 which indicates that the coring bit 44 is now retracting past its 5-inch extension. Similarly, when the coring bit 44 retracts to the 4-inch extension, the cam button 143 will actuate the microswitch 157 which energizes relay 348 by applying negative voltage appearing at contact 3 of the de-energized relay 334 through the coil of relay 348, section B of switch 322 (switch position 2), contact 366, the wireline cable 22, panel contact 362 and through switch 157 to ground. Again, as soon as the cam 141' starts to rotate clockwise the button breaks contact with switch 157 and the ground connection is broken, thus de-energizing relay 348. The momentary energizing of relay 348 interrupts the ground connection to the contact 1 of the relay 332 and de-energizes relay 332, and de-energizes lamp 333 which indicates that the coring bit 44 is now retracting past its 4-inch extension.

The cam 141' will actuate each of the remaining switches 153, 149, 147 and 145 in turn as the coring bit retracts into the body of the tool 20 in the identical manner as above described, de-energizing relays 330, 328, 326 and 324 and associated lamps 331, 329, 327, and 325, respectively. When the bit 44 is fully retracted, the last lamp 325 is de-energized and indicated that the bit has been fully retracted into the tool 20. The advance cycle is now ready to be repeated. The monitoring circuit will permit the indication of the bit advance and retraction even though the bit may not be fully advanced or retracted when the advance or retract cycle is reversed and will function in the identical manner as above described, with the appropriate number of lamps always indicating the true position of the bit 44 with respect to the tool 20.

Many modifications and variations besides those specifically mentioned may be made without substantially departing from the concept of the present invention. Accordingly, it should be clearly understood that the forms of the invention described and illustrated herein are exemplary only and are not intended as limitations on the scope of the present invention.

What is claimed is:

1. A sidewall coring tool for wireline use in an earth bore hole, comprising:

an elongated tool body adapted for suspension within the bore hole by the wireline cable at a selected depth;

rotary coring bit apparatus mounted within said elongated tool body and cooperating therewith for advancing and retracting a rotary coring bit transversely therefrom for drilling and recovering a large core sample from the sidewall of the bore hole, the rotary coring apparatus further including an automatic bit pressure compensation during advance of the coring bit;

decentralizing arm apparatus mounted in said tool body on the side opposite the side of the body from which said rotary coring bit is advanced, said decentralizing arm apparatus spaced above and below the location of the rotary coring apparatus for deploying decentralizing arms from said tool body into contact with the bore hole walls and forcing the side of the tool body from which the rotary coring bit will be advanced into contact with the bore hole wall and maintaining the tool body rigidly against the bore hole wall during the coring operation;

an electrical control circuit disposed on the earth's surface for permitting selected control of preselected functions of said coring apparatus; and monitoring apparatus and circuitry disposed in the tool body and cooperating with said rotary coring bit apparatus for permitting continuous surface visual indication of the travel of the coring bit with respect to the tool body during the coring operation.

2. The coring tool as described in claim 1, wherein the rotary coring apparatus is capable of obtaining large sidewall core samples.

3. The coring tool as described in claim 1, wherein said decentralizing arm apparatus is automatically unlocked if there is a hydraulic system failure.

4. The coring tool as described in claim 1, further including a pressurized fluid delivery system for flushing out the drilling cuttings and debris during the rotary coring.

5. The coring tool as described in claim 1, wherein said rotary coring apparatus permits the reversal of direction of the rotation of the coring bit for permitting unscrewing of the bit if it becomes stuck in the formation.

6. The coring tool as described in claim 1, wherein the rotary coring apparatus includes a low speed high torque driving means for permitting coring in extremely hard rock.

* * * * *